US008783388B1

(12) United States Patent
Pope

(10) Patent No.: US 8,783,388 B1
(45) **Date of Patent: *Jul. 22, 2014**

(54) SUPERABRASIVE INSERTS INCLUDING AN ARCUATE PERIPHERAL SURFACE

(71) Applicant: US Synthetic Corporation, Orem, UT (US)

(72) Inventor: Eric C. Pope, Provo, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/919,458

(22) Filed: Jun. 17, 2013

Related U.S. Application Data

(63) Continuation of application No. 13/606,318, filed on Sep. 7, 2012, now Pat. No. 8,505,655, which is a continuation of application No. 12/259,901, filed on Oct. 28, 2008, now Pat. No. 8,272,459, which is a continuation of application No. 11/334,214, filed on Jan. 17, 2006, now Pat. No. 7,475,744.

(60) Provisional application No. 60/644,665, filed on Jan. 17, 2005.

(51) Int. Cl.
*E21B 10/46* (2006.01)

(52) U.S. Cl.
USPC ..... 175/430; 175/374; 175/426; 175/431; 175/432

(58) Field of Classification Search
USPC ..... 175/374, 426, 430, 431, 432
See application file for complete search history.

(56) References Cited

U.S. PATENT DOCUMENTS

| | | | |
|---|---|---|---|
| 3,745,623 | A | 7/1973 | Wentorf, Jr. et al. |
| 4,109,737 | A | 8/1978 | Bovenkerk |
| 4,539,018 | A | 9/1985 | Whanger et al. |
| RE32,036 | E | 11/1985 | Dennis |
| 4,629,373 | A | 12/1986 | Hall |
| 4,941,891 | A | 7/1990 | Tank et al. |
| 4,987,800 | A | 1/1991 | Gasan et al. |
| 5,016,718 | A | 5/1991 | Tandberg |
| 5,287,936 | A | 2/1994 | Grimes et al. |
| 5,341,890 | A | 8/1994 | Cawthorne et al. |
| 5,346,026 | A | 9/1994 | Pessier et al. |
| 5,351,770 | A | 10/1994 | Cawthorne et al. |
| 5,370,717 | A | 12/1994 | Lloyd et al. |
| 5,437,343 | A | 8/1995 | Cooley et al. |
| 5,443,565 | A | 8/1995 | Strange, Jr. |
| 5,467,836 | A | 11/1995 | Grimes et al. |
| 5,469,927 | A | 11/1995 | Griffin |

(Continued)

*Primary Examiner* — Sean Andrish
(74) *Attorney, Agent, or Firm* — Holland & Hart LLP

(57) ABSTRACT

Superabrasive inserts are disclosed. More particularly, a superabrasive insert may comprise a superabrasive layer bonded to a substrate at an interface. Further, the superabrasive layer may include a central substantially planar surface, a peripheral side surface, and an arcuate peripheral surface extending between the central substantially planar surface and the peripheral side surface. In one embodiment, the arcuate peripheral surface may comprise a lateral extent and an extension depth, wherein a ratio of the lateral extent to the extension depth is at least about 1.5. In another embodiment, an arcuate peripheral surface may comprise a substantially circular arc, wherein the substantially planar surface is tangent to the substantially circular arc and a tangent reference line to the substantially circular arc forms an angle of at least about 10° with the peripheral side surface. Subterranean drilling tools (e.g., drill bits) including at least one superabrasive insert are disclosed.

18 Claims, 13 Drawing Sheets
(3 of 13 Drawing Sheet(s) Filed in Color)

(56) References Cited

U.S. PATENT DOCUMENTS

| | | | | |
|---|---|---|---|---|
| 5,560,754 | A | 10/1996 | Johnson et al. | |
| 5,655,612 | A | 8/1997 | Grimes et al. | |
| 5,709,278 | A | 1/1998 | Crawford | |
| 5,711,702 | A | 1/1998 | Devlin | |
| 5,722,497 | A | 3/1998 | Gum et al. | |
| 5,848,348 | A | 12/1998 | Dennis | |
| 5,871,060 | A | 2/1999 | Jensen et al. | |
| 5,890,552 | A | 4/1999 | Scott et al. | |
| 6,011,248 | A | 1/2000 | Dennis | |
| 6,050,354 | A | 4/2000 | Pessier et al. | |
| 6,063,333 | A | 5/2000 | Dennis | |
| 6,189,634 | B1 | 2/2001 | Bertagnolli et al. | |
| 6,202,770 | B1 | 3/2001 | Jurewicz et al. | |
| 6,230,828 | B1 | 5/2001 | Beuershausen et al. | |
| 6,260,639 | B1 | 7/2001 | Yong et al. | |
| 6,330,924 | B1 | 12/2001 | Hall | |
| 6,443,249 | B2 | 9/2002 | Beuershausen et al. | |
| 6,672,406 | B2 | 1/2004 | Beuershausen | |
| 6,719,074 | B2 | 4/2004 | Tsuda et al. | |
| 6,739,417 | B2 | 5/2004 | Smith et al. | |
| 6,883,623 | B2 | 4/2005 | McCormick et al. | |
| 6,935,444 | B2 | 8/2005 | Lund et al. | |
| 7,475,744 | B2 | 1/2009 | Pope | |
| 7,608,333 | B2 | 10/2009 | Eyre | |
| 8,272,459 | B2 * | 9/2012 | Pope | 175/430 |
| 8,505,655 | B1 * | 8/2013 | Pope | 175/430 |
| 2003/0116361 | A1 * | 6/2003 | Smith et al. | 175/428 |
| 2004/0112650 | A1 | 6/2004 | Moseley | |
| 2004/0163854 | A1 * | 8/2004 | Lund et al. | 175/431 |

* cited by examiner

SUPERABRASIVE INSERTS INCLUDING AN ARCUATE PERIPHERAL SURFACE

CROSS-REFERENCE TO RELATED APPLICATIONS

This application is a continuation of U.S. patent application Ser. No. 13/606,318, filed 7 Sep. 2012, now U.S. Pat. No. 8,505,655, issued 13 Aug. 2013 which is a continuation of U.S. application Ser. No. 12/259,901, filed 28 Oct. 2008, now U.S. Pat. No. 8,272,459, issued 25 Sep. 2012, which is a continuation of U.S. application Ser. No. 11/334,214, filed 17 Jan. 2006, now U.S. Pat. No. 7,475,744, issued 13 Jan. 2009, which claims the benefit of U.S. Patent Application No. 60/644,665, filed 17 Jan. 2005, the disclosures of each of which are incorporated, in their entireties, by this reference.

BACKGROUND

Polycrystalline diamond inserts ("PCD inserts") often form at least a portion of a cutting structure of a subterranean drilling or boring tools; including drill bits (fixed cutter, roller cone and percussion bits,) reamers, and stabilizers. Such tools, as known in the art, may be used in exploration and production relative to the oil and gas industry. PCD inserts may also be utilized as wear or cutting pads on the gage of downhole tools in order to cut and/or maintain the hole diameter. Such a PCD insert may be known as a PCD gage insert. A variety of PCD gage inserts are known in the art.

Tensile stress zones are often developed due, at least in part, to the thermal expansion differences between polycrystalline diamond and a substrate to which the polycrystalline diamond becomes bonded to during a high-pressure/high-temperature (HPHT) process. Accordingly, tensile stress may be present in nearly all PCD products. The manufacturing process of PCD inserts creates residual stresses that often include tensile stress zones in the polycrystalline diamond. Tensile stress zones or regions may also be developed in response to applied forces or moments (on either the polycrystalline diamond, the substrate, or both) in combination with residual stresses.

Diamond is a brittle material that will not sustain high tensile loading. Residual and applied load stresses combined can significantly affect the performance of a PCD insert (e.g., a PCD gage insert). A polycrystalline diamond PCD gage insert (otherwise known as a diamond enhanced insert or "DEI") may be manufactured by various methods which are known in the art. For example, one process includes placing a substrate adjacent to a layer of diamond crystals in a refractory metal can. Further, a back can is then positioned over the substrate and sealed to form a can assembly, The can assembly is then placed into a cell made of an extrudable material such as pyrophyllite or talc. The cell is then subjected to conditions necessary for diamond-to-diamond bonding or sintering conditions in a high pressure/high temperature press.

Accordingly, tensile stresses developed within any portion of polycrystalline diamond, are believed to be detrimental to DEIs, gage elements, or wear elements (e.g., as used on subterranean drilling tools). Such tensile stresses are also believed to contribute to premature damage (e.g., spalling, chipping, or delamination) of the polycrystalline diamond. On the other hand, some residual stresses are believed to be beneficial. Particularly, compressive stress developed within the polycrystalline diamond of a PCD insert are believed to be beneficial and may improve the durability of the polycrystalline diamond during use. Moderate to relatively high compressive residual stresses within a polycrystalline diamond table or layer may inhibit fracture initiation and development.

Conventionally, residual stresses have been managed via the diamond/substrate design (e.g., an interface between the polycrystalline diamond and the substrate, size of the diamond and/or substrate, shape of the diamond and/or substrate, etc.). Other methods for affecting residual stresses, including, for example, transition layers between the diamond and carbide to provide a gradient of thermal expansion properties, are known in the art. Such residual stress management methods may create residual stresses that, to a limited extent, improve toughness of a PCD insert.

However, in addition to residual stress developed within a PCD, a mounting process for affixing a PCD insert to a drilling tool (e.g., brazing or press fitting the insert for attachment to the tool) may influence the stresses within the PCD insert. More particularly, press fitting or brazing will apply forces to a PCD insert that will influence and complicate the residual stress state. Generally PCD gage inserts are mechanically attached to a downhole tool by a press or interference fit. An interference fit induces compressive stresses on the enclosed material, which is typically a portion of the substrate of a PCD insert. The interference fit may create a bending moment on the exposed portion of the PCD insert. As discussed below, finite element analysis (FEA) predicts that a peripheral ring of tensile stress in the diamond table will develop due to residual stresses and the stresses developed by press fitting a conventional PCD insert, which is also described below, within a hole.

FIGS. 1, 2, and 3 show a perspective view, a schematic, side cross-sectional view, and a partial, enlarged, side cross-sectional view of a conventional DEI 10 comprising a substrate 12 bonded to a diamond layer 20 at an interface 33 (see FIG. 4). More particularly, referring to FIGS. 1-3, a radius 16 is formed on a peripheral edge of the diamond layer 20, wherein a cross-sectional shape of the radius 16 is substantially a quarter circle (e.g., a circular arc formed by 90° central angle). Of course, one of ordinary skill in the art will understand that this radius feature may be annular and is generally formed upon a circumferential edge region of the diamond layer 20. In further detail, side surface 24 of diamond layer 20 as well as substantially planar surface 22 of diamond table 20 are both substantially tangent to the radius 16 (for a given cross-sectional plane) at respective intersection edges or lines. Such a configuration may be referred to as a "one-quarter radius." Also, manufacturing processes for forming a one-quarter radius may often include a break out angle that causes the substantially planar surface 22 and the side surface 24 of the diamond layer 20 to not be exactly tangent to the curve forming the radius 16.

FIG. 4 shows a partial sectioned view of conventional DEI 10, wherein DEI is shaded according to data representing a stress field within the conventional DEI 10 shown in FIGS. 1-3. Particularly, FIG. 4 was generated by using finite element analysis to simulate the residual stresses developed during HPHT sintering of the diamond layer 20 and substrate 12 as well as stresses developed in response to press fitting the substrate within a hole formed in a steel material (e.g., an applied pressure or force about at least a portion of the periphery of the substrate). As shown in FIG. 4, a substantially continuous, circumferentially extending zone or region 31 of tensile stress is indicated proximate to the radius 16. As shown in FIG. 4, a tensile stress of about $5.746\ 10^4$ psi. may be developed. Such a tensile stress zone may be detrimental if the DEI 10 is used a cutting or wear element on a subterranean drill bit, because typically at least a portion of the radius 16 may be forced against a subterranean formation and, therefore, may be subjected to relatively high additional localized applied stresses.

FIGS. 5 and 6 show a schematic side cross-sectional view and a partial enlarged side cross-sectional view of another conventional DEI 50 comprising a diamond layer 51 and a substrate 54, wherein a relatively small (e.g., 0.010 inch) chamfer 52 is formed on a peripheral edge of the diamond layer 52 (i.e., between planar surface 56 and side surface 58 of diamond layer 51) at a 45° angle θ with respect to planar surface 56 of diamond layer 51. As known in the art, an interface between diamond layer 51 and substrate 54 may be nonplanar. FIG. 7 shows a further conventional DEI 60 comprising a diamond layer 61 and a substrate 64, wherein a relatively large (e.g., 0.040 inches-0.070 inches) chamfer 62 is formed on a peripheral edge of diamond layer 61 (i.e., between planar surface 66 and side surface 68 of diamond layer 61). As shown in FIG. 7, chamfer 62 is formed at a 45° angle θ with respect to planar surface 66 of diamond later 61. FIG. 8 shows yet an additional conventional DEI 70 comprising a diamond layer 72 and a substrate 74, wherein the diamond layer 72 forms a substantially hemispherical surface 76. Generally, each of these conventional DEIs may exhibit undesirable tensile stresses within at least a portion of their respective polycrystalline diamond structure.

Thus, it would be advantageous to provide a superabrasive insert (e.g., a polycrystalline diamond insert) with a selected arcuate peripheral surface geometry. In addition, it would be beneficial to provide a superabrasive insert exhibiting a selected peripheral surface that produces, at least in part, an associated beneficial residual stress field. Of course, subterranean drill bits including at least one such polycrystalline diamond insert may also be beneficial.

SUMMARY

The present invention relates generally to superabrasive insert comprising a superabrasive layer or table formed or otherwise bonded to a substrate. For example, a superabrasive insert may comprise polycrystalline diamond, silicon carbide, cubic boron nitride, or any material exhibiting a hardness greater than tungsten carbide. In one embodiment, a superabrasive layer may comprise polycrystalline diamond and a substrate may comprise cemented tungsten carbide. Any of the inserts encompassed by this disclosure may be employed in subterranean drilling tools of any known type. In one embodiment, at least one superabrasive insert may be employed as a gage insert in a subterranean drilling or boring tool (e.g., a roller cone drill bit, a fixed cutter drill bit, a reamer, a reamer wing, an eccentric bit, a percussion bit, a bi-center bit, a core bit, etc.).

One aspect of the present invention relates to a superabrasive insert. More particularly, a superabrasive insert may comprise a superabrasive layer bonded to a substrate at an interface. Further, the superabrasive layer may include a central substantially planar surface, a peripheral side surface, and an arcuate peripheral surface extending between the central substantially planar surface and the peripheral side surface. In addition, the arcuate peripheral surface may comprise a lateral extent and an extension depth, wherein a ratio of the lateral extent to the extension depth is at least about 1.5.

Another aspect of the present invention relates to a superabrasive insert. Particularly, a superabrasive insert may comprise a superabrasive layer bonded to a substrate at an interface. In addition, the superabrasive layer may include a central substantially planar surface, a peripheral side surface, and an arcuate peripheral surface extending between the central substantially planar surface and the peripheral side surface. Such an arcuate peripheral surface may include a cross section comprising a substantially circular arc, wherein the substantially planar surface is tangent to the substantially circular arc. Also, a tangent reference line to the substantially circular arc extending from an intersection between the peripheral side surface of the superabrasive and the substantially circular arc may form an angle of at least about 10° with the peripheral side surface.

In one embodiment, a rotary drill bit for drilling a subterranean formation may comprise a bit body comprising a leading end structured for facilitating forming a borehole in a subterranean formation and a gage surface including at least one gage insert. In further detail, the at least one gage insert may comprise a superabrasive layer bonded to a substrate at an interface. Further, the superabrasive layer may include a central substantially planar surface, a peripheral side surface, and an arcuate peripheral surface extending between the central substantially planar surface and the peripheral side surface. In addition, the arcuate peripheral surface may comprise a lateral extent and an extension depth, wherein a ratio of the lateral extent to the extension depth is at least about 1.5.

Features from any of the above mentioned embodiments may be used in combination with one another, without limitation. In addition, other features and advantages of the instant disclosure will become apparent to those of ordinary skill in the art through consideration of the ensuing description, the accompanying drawings, and the appended claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Further features of the subject matter of the instant disclosure, its nature, and various advantages will be more apparent from the following detailed description and the accompanying drawings, which illustrate various exemplary embodiments, are representations, and are not necessarily drawn to scale, wherein.

DETAILED DESCRIPTION

The present invention relates generally to inserts comprising a superabrasive material (e.g., polycrystalline diamond) bonded to a substrate. The term "superabrasive," as used herein, means a material exhibiting a hardness at least equal to a hardness of tungsten carbide. For example, polycrystalline diamond, cubic boron nitride, and silicon carbide, without limitation, each exhibits a respective hardness that equals or exceeds a hardness of tungsten carbide. As described above, a superabrasive material may be formed upon and bonded to a substrate by HPHT sintering.

In one embodiment, one aspect of the present invention relates to an insert or compact including a superabrasive layer formed upon a substrate, wherein the superabrasive layer includes an arcuate peripheral surface. In addition, the superabrasive layer may include a substantially planar surface which is substantially tangent to (for a given cross-sectional plane) a curve forming the arcuate peripheral surface at the intersection between the substantially planar surface and the arcuate peripheral surface. Further, a peripheral side surface of the superabrasive layer may not be substantially tangent (for a given cross-sectional plane) to a curve forming the arcuate peripheral surface at the intersection between the peripheral side surface and a curve forming the arcuate peripheral surface. Put another way, a line (or plane) tangent to the curve forming the arcuate peripheral surface geometry may form an angle with the peripheral side surface of the superabrasive layer. In one embodiment such an angle may be greater than about 10°. Optionally, the substantially planar surface of the superabrasive layer may be substantially perpendicular to the peripheral side surface of the superabrasive layer.

Figure 9:
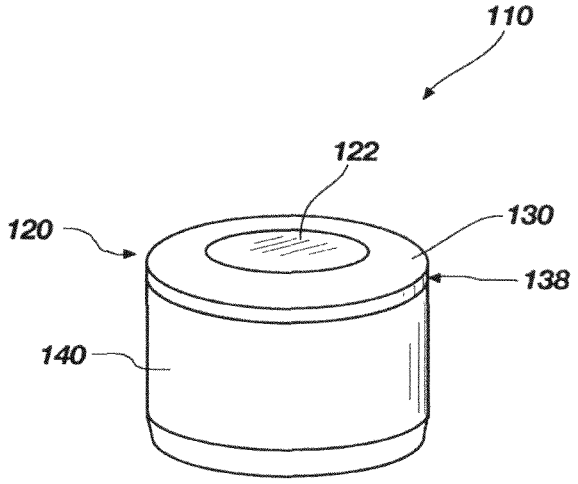
FIG. 9 shows a perspective view of one embodiment of a superabrasive insert according to the present invention.
Figure 10:
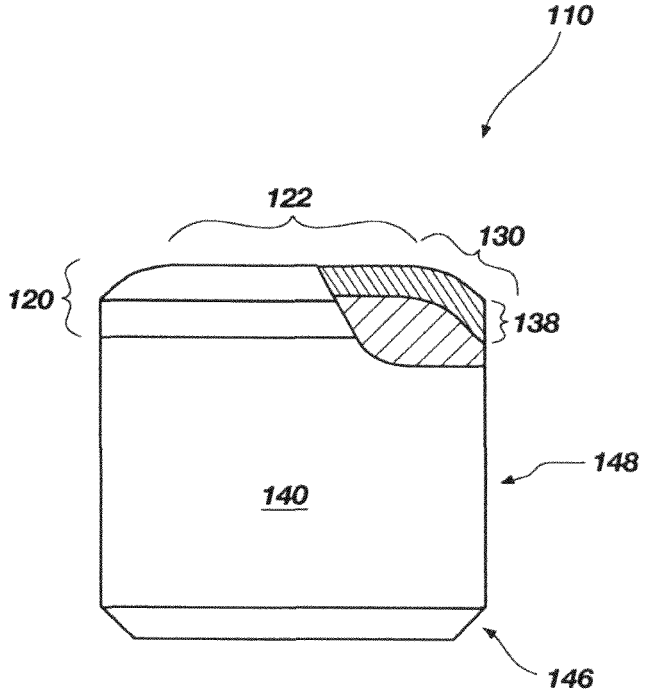
FIG. 10 shows a schematic, partial side view and side cross-sectional view of the superabrasive insert shown in FIG. 9.

For example, FIG. 9 shows a superabrasive insert 110 including a superabrasive layer 120 (or table) formed upon a substrate 140. In further detail, superabrasive layer 120 may comprise a central, substantially planar surface 122, a side surface 138, and an arcuate peripheral surface 130 extending between the central, substantially planar surface 122 and the side surface 138. Optionally, substantially planar surface 122 and side surface 138 may be substantially perpendicular to one another (for a given cross-sectional plane intersecting both planar surface 122 and side surface 138). FIG. 10 shows a schematic, partial side and side cross-sectional view of superabrasive insert 110. In further detail, FIG. 10 shows superabrasive layer 120 formed upon substrate 140. In one embodiment, superabrasive layer 120 may comprise polycrystalline diamond and substrate 140 may comprise cemented tungsten carbide. Also, in one embodiment, side surface 148 of substrate 140 may be generally cylindrical and may include a relief feature 146 (e.g., a chamfer or radius) that removes a sharp peripheral edge (e.g., a circumferential edge) that may be otherwise formed upon substrate 140.

Figure 11:
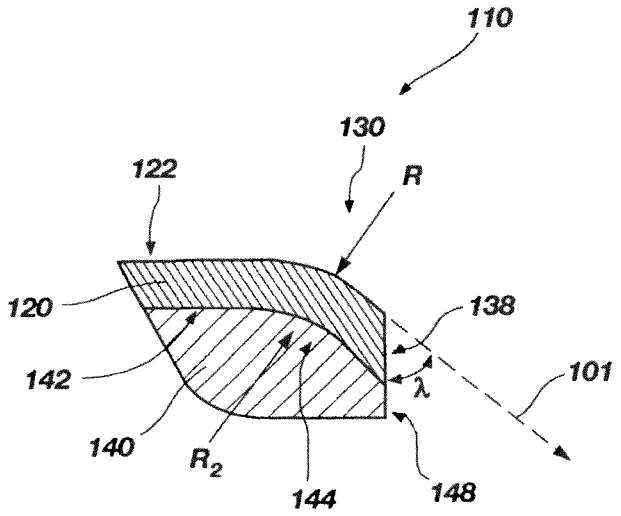
FIG. 11 shows an enlarged view of one embodiment of an arcuate peripheral surface of the superabrasive insert shown in FIGS. 9 and 10.

In greater detail, FIG. 11 shows a schematic, side cross-sectional view of a portion of superabrasive insert 110. As shown in FIG. 11, central, substantially planar surface 122 of superabrasive layer 120 may be substantially tangent to a curve defining arcuate peripheral surface 130 (for a given cross-sectional plane intersecting both substantially planar surface 122 and arcuate peripheral surface 130). In one embodiment, a cross-sectional shape of arcuate peripheral surface 130 may comprise a substantially circular arc exhibiting a radius R. Accordingly, arcuate peripheral surface 130 may comprise a surface of revolution formed by rotating a substantially circular arc about a central axis (e.g., an axis positioned generally at a centroid of substantially planar surface 122 and substantially perpendicular to substantially planar surface 122) of superabrasive insert 110. For example, arcuate peripheral surface 130 may comprise a surface of revolution formed by rotating a substantially circular arc having a radius R of about 0.100 inches about a central axis. As shown in FIG. 11, substrate 140 may include a central substantially planar interface surface 142, a side surface 148, and a peripheral arcuate interface surface 144 extending between substantially planar interface surface 142 and side surface 148. In one embodiment, central, substantially planar interface surface 142 of substrate 140 may be substantially tangent to a curve defining peripheral arcuate interface surface 144 of substrate 140 (for a given cross-sectional plane intersecting both substantially planar interface surface 142 and peripheral arcuate interface surface 144). In one embodiment, a cross-sectional shape of arcuate peripheral surface 144 may comprise a substantially circular arc exhibiting a radius $R_2$. Accordingly, arcuate peripheral interface surface 144 may comprise a surface of revolution formed by rotating a substantially circular arc about a central axis (e.g., an axis positioned generally at a centroid of substantially planar surface 142 and substantially perpendicular to substantially planar surface 142) of superabrasive insert 110. For example, arcuate peripheral interface surface 144 may comprise a surface of revolution formed by rotating a substantially circular arc having a radius $R_2$ of about 0.100 inches about a central axis.

Figure 12:
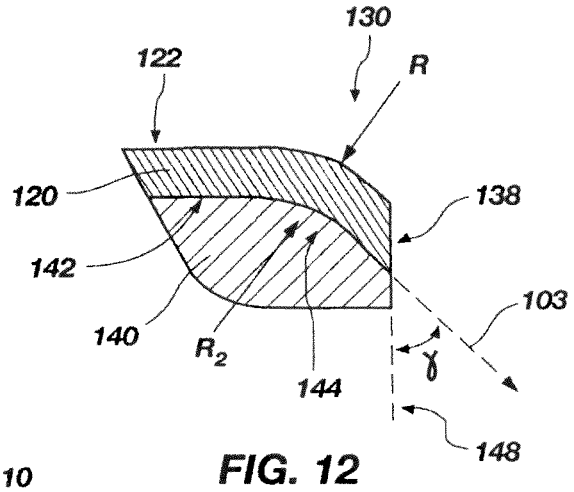
FIG. 12 shows another enlarged view of the arcuate peripheral surface of the superabrasive insert shown in FIGS. 9 and 10.

The present invention generally contemplates that a peripheral side surface of a superabrasive layer may form an angle (or edge) with a peripheral arcuate surface of a superabrasive layer. For example, FIG. 11 shows a tangent reference line 101 that is tangent to the curve defining arcuate peripheral surface 130 at the intersection of arcuate peripheral surface 130 and side surface 138. As shown in FIG. 11, an angle λ may be formed between tangent reference line 101 and side surface 138 of diamond layer 120. In one embodiment, angle λ may be at least about 10°. More generally, angle λ may be between 5° and 75°. In a particular example, angle λ may be about 40°. Thus, arcuate peripheral surface 130 may not be tangent to side surface 138 at the intersection between arcuate peripheral surface 130 and side surface 138. In addition, a peripheral side surface of a substrate may form an angle (or edge) with a peripheral arcuate interface surface of the substrate. For instance, FIG. 12 shows a tangent reference line 103 that is tangent to the curve defining arcuate peripheral interface surface 144. As shown in FIG. 12, an angle γ may be formed between tangent reference line 103 and side surface 148 of substrate 140. In one embodiment, angle γ may be at least about 10°. More generally, angle λ may be between 5° and 75°. In a particular example, angle γ may be about 40°. Thus, arcuate peripheral interface surface 144 may not be tangent to side surface 148 of substrate 140 at the intersection between arcuate peripheral surface 144 and side surface 148.

Optionally, in one embodiment, an interface between a substrate and a superabrasive layer may be generally congruous with respect to an upper topography of a superabrasive layer. More particularly, as shown in FIGS. 9-12, substantially planar interface surface 142 of substrate 140 may be generally congruous to substantially planar surface 122 of superabrasive layer 120. In addition, arcuate peripheral interface surface 142 of substrate 140 may be generally congruous to arcuate peripheral surface 130 of superabrasive layer 120. Accordingly, in one embodiment, arcuate peripheral interface surface 142 of substrate 140 may be a surface of revolution formed by a substantially circular arc exhibiting a radius $R_2$ of about 0.100 and arcuate peripheral surface 130 of superabrasive layer 120 may be a surface of revolution formed by a substantially circular arc exhibiting a radius R of about 0.100.

Figure 13:
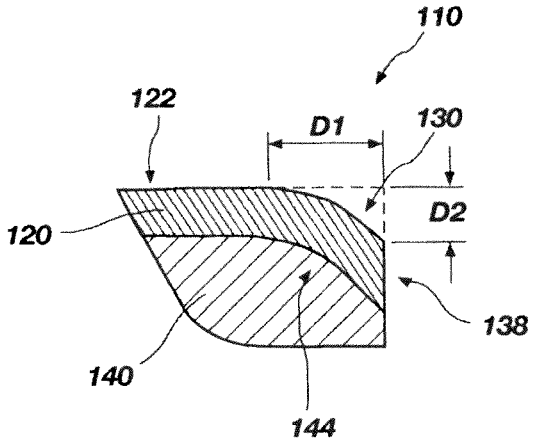
FIG. 13 shows a further enlarged view of the arcuate peripheral surface of the superabrasive insert shown in FIGS. 9 and 10.

Another aspect of the present invention relates to a relationship between a lateral extent of an arcuate peripheral surface of a superabrasive layer in relation to an extension depth of the arcuate peripheral surface of the superabrasive layer. More specifically, FIG. 13 shows a schematic side cross-sectional view of superabrasive insert 110 including arcuate peripheral surface 130. As shown in FIG. 13, a lateral distance D1 (i.e., a lateral extent) of arcuate peripheral surface 130 may be greater than an extension depth D2 of arcuate peripheral surface 130. In one embodiment, a ratio of a lateral distance D1 to an extension depth D2 (i.e., D1/D2) may be about 1.5. Such a configuration may reduce or eliminate detrimental tensile residual stresses proximate to an arcuate peripheral surface of a superabrasive insert. For example, D1 may equal about 0.0708 inches, while D2 may equal about 0.030 inches. Thus, a ratio of D1 to D2 in such an embodiment would be about 2.36.

Figure 14:
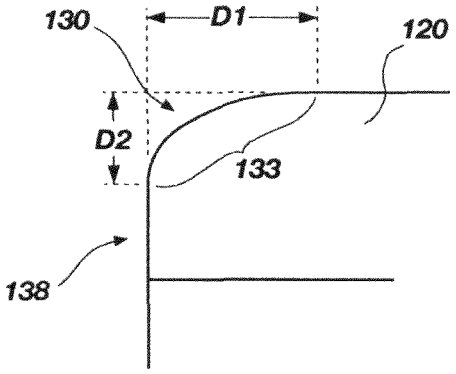
FIGS. 14-19 each show a respective embodiment of an arcuate peripheral surfaces according to the present invention.
Figure 16:
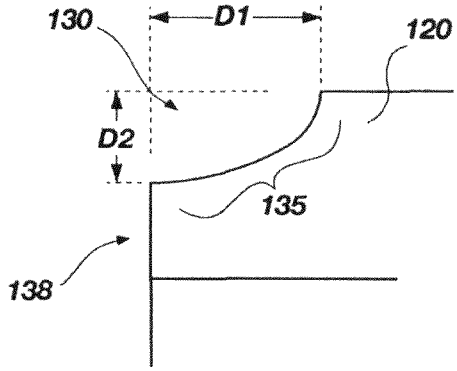
Figure 15:
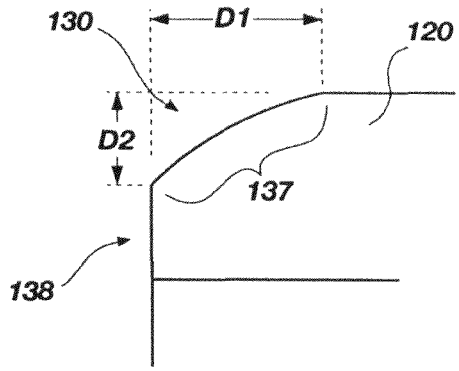

Of course, the present invention contemplates a variety of additional arcuate peripheral surface geometries. For example, FIGS. 14-16 show additional embodiments of arcuate peripheral surfaces 130 formed between a substantially planar surface 122 of superabrasive layer 120 and a side surface 138 of superabrasive layer 120. Particularly, FIG. 14 shows a schematic, side cross-sectional view of a superabrasive layer 120 including an arcuate peripheral surface 130 comprising a surface of revolution formed by an elliptical arc 133. In another embodiment, FIG. 15 shows a schematic, side cross-sectional view of a noncircular curve 137 that forms arcuate peripheral surface 130 of superabrasive layer 120. In yet an additional embodiment, FIG. 16 shows a schematic, side cross-sectional view of a superabrasive layer 120 including an arcuate peripheral surface 130 comprising a concave exterior surface. More specifically, as shown in FIG. 16, arcuate peripheral surface 130 comprises an elliptical arc 135 that forms a concave exterior surface of superabrasive layer 120.

Figure 19:
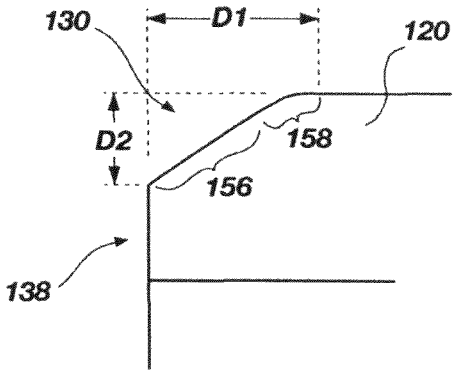
Figure 18:
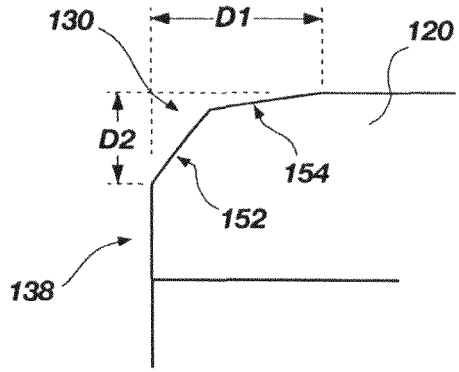
Figure 17:
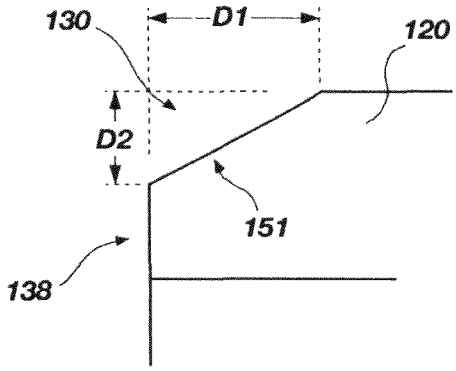

In another aspect of the present invention, an arcuate peripheral surface of a superabrasive table may comprise one or more chamfer features (e.g., a surface of revolution formed by rotation of one or more substantially straight lines about a central axis). For example, FIG. 17 shows a schematic, side cross-sectional view of a superabrasive layer 120 including an arcuate peripheral surface 130 comprising a chamfer feature 151. In another embodiment, FIG. 18 shows a schematic, side cross-sectional view of a superabrasive layer 120 including an arcuate peripheral surface 130 comprising a plurality of chamfer features 152 and 154. In yet further embodiments, an arcuate peripheral surface may comprise a combination of chamfer features and arcuate curves. For example, FIG. 19 shows a schematic, side cross-sectional view of a superabrasive layer 120 including an arcuate peripheral surface 130 comprising a chamfer feature 156 and an arcuate curve 158. Of course, the present invention further contemplates that an arcuate peripheral surface may comprise a plurality of arcuate curves, without limitation. As discussed above, any of the arcuate peripheral surface embodiments shown in FIGS. 14-19 may exhibit a ratio of D1 to D2 exceeding 1.0. In one particular embodiment, a ratio of D1 to D2 may be about 1.5.

An arcuate peripheral surface may be formed during a HPHT sintering process, and thus, may be described as an "as-pressed" surface. In another embodiment, an arcuate peripheral surface may be manufactured by machining (e.g., grinding, lapping, electro-discharge machining, etc.) to a selected shape. Of course, at least a portion of an arcuate peripheral surface may be "as-pressed," while another portion of the arcuate peripheral surface may be machined, without limitation. Similarly, a substantially planar surface may be "as-pressed," ground, lapped, otherwise formed after HPHT sintering, or combinations of the foregoing, as known in the art. It will also be understood by one of ordinary skill in the art that an arcuate peripheral surface may be formed upon a selected or limited (circumferential) portion or region of a superabrasive layer. Put another way, the present invention contemplates that an arcuate peripheral surface may be a surface of revolution formed by rotation of a curve (e.g., a straight line, an arc, or a curve) about a selected axis over a selected angle (e.g., less than or equal to) 360°. In one embodiment, a subterranean formation contacting portion of a superabrasive table may include an arcuate peripheral surface.

Relative to polycrystalline diamond, as known in the art, during sintering of polycrystalline diamond, a catalyst material (e.g., cobalt, nickel, etc.) may be employed for facilitating formation of polycrystalline diamond. More particularly, as known in the art, diamond powder placed adjacent to a cobalt-cemented tungsten carbide substrate and subjected to a HPHT sintering process may wick or sweep molten cobalt into the diamond powder which remains in the polycrystalline diamond table upon sintering and cooling. In other embodiments, catalyst may be provided within the diamond powder, as a layer of material between the substrate and diamond powder, or as otherwise known in the art. As also known in the art, such a catalyst material may be at least partially removed (e.g., by acid-leaching or as otherwise known in the art) from at least a portion of the polycrystalline diamond (e.g., a table) formed upon the substrate. In one embodiment, catalyst removal may be substantially complete to a selected depth from an exterior surface of the polycrystalline diamond table, if desired, without limitation. Such catalyst removal may provide a polycrystalline diamond material with increased thermal stability, which may also beneficially affect the wear resistance of the polycrystalline diamond material. Thus, the present invention contemplates that any superabrasive insert discussed in this application may comprise polycrystalline diamond from which at least a portion of a catalyst used for forming the polycrystalline diamond is removed.

Figure 20A:
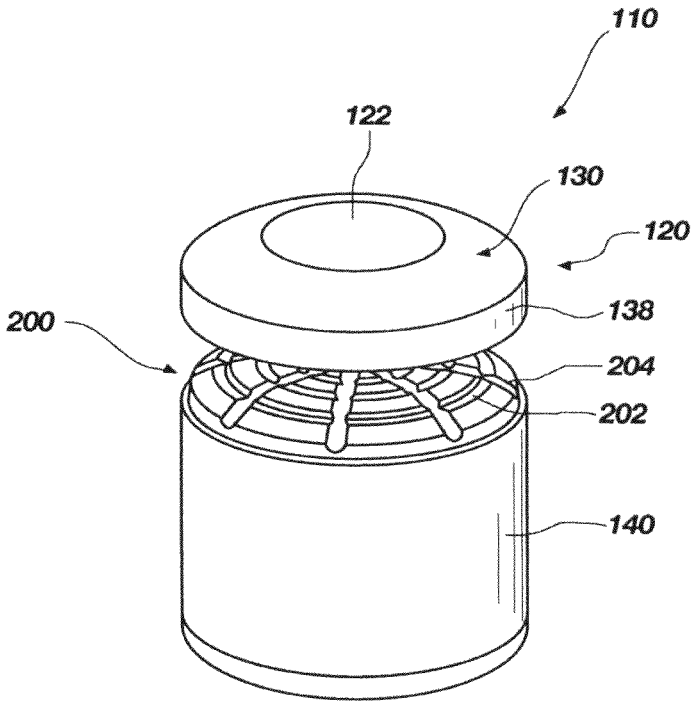
FIG. 20A shows an exploded perspective view of a further embodiment of a superabrasive insert according to the present invention.

The present invention further contemplates that various interfacial surfaces may be formed between a superabrasive layer and a substrate. In one embodiment, an interfacial surface between a superabrasive layer and a substrate may be substantially planar or at least generally planar. In other embodiments, an interfacial surface between a superabrasive layer and a substrate may be nonplanar (e.g., ovoid, domed, substantially hemispherical, etc.). For example, FIG. 20A shows an exploded view of a superabrasive insert 110 including a superabrasive layer 120 bonded to a substrate 140 over a generally domed interface 200. As shown in FIG. 20A, substrate may include one or more circumferentially extending grooves 202 and/or one or more radially extending grooves 204. As known in the art, such grooves may each exhibit selected dimensions (e.g., depth, width, shape, etc.). Such a configuration may improve the integrity or strength of the bond between a superabrasive layer and a substrate. As mentioned above, an interfacial surface between a superabrasive layer and a substrate may generally mimic or follow an exterior surface of the superabrasive layer, if desired. In summary, generally substantially planar and generally nonplanar interface geometries may further include, without limitation, non-planar features including protrusions, grooves, and depressions. Such nonplanar features may enhance an attachment strength of the superabrasive table to the substrate.

Figure 20B:
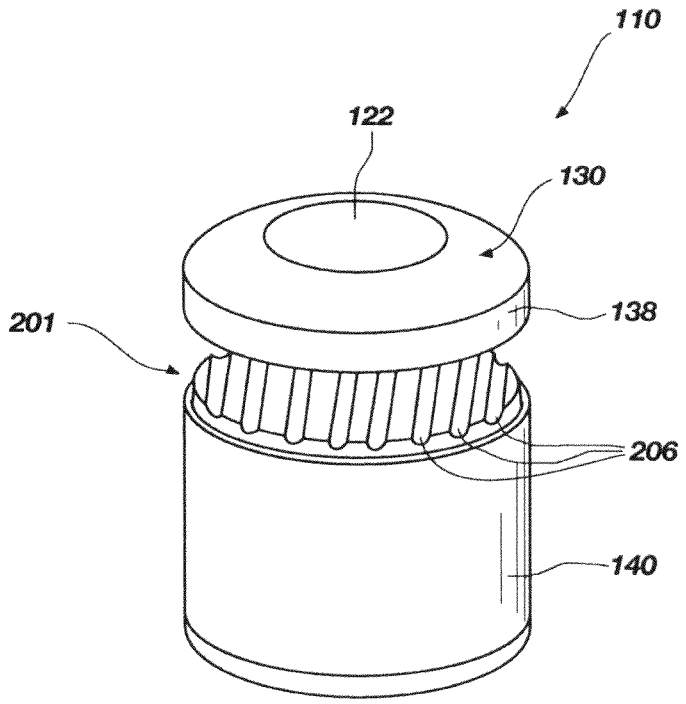
FIG. 20B shows an exploded perspective view of an additional embodiment of a superabrasive insert according to the present invention.

In a further embodiment, a plurality of substantially linear or straight grooves may form an interface between a superabrasive layer and a substrate. For example, FIG. 20B shows an exploded view of a superabrasive insert 110 including a superabrasive layer 120 bonded to a substrate 140 over a generally planar interface 201. As shown in FIG. 20B, substrate may include one or more grooves 206, which may, optionally, be substantially parallel to one another. As known in the art, such grooves 206 may each exhibit selected dimensions (e.g., depth, width, shape, etc.). Such a configuration may improve the integrity or strength of the bond between a superabrasive layer and a substrate. Of course, such grooves may be formed upon a domed or otherwise arcuate topography or upon a substantially planar topography, without limitation. Such nonplanar features may enhance an attachment strength of the superabrasive layer to the substrate or may provide a desired geometry to the superabrasive layer, the substrate, or both.

Figure 1:
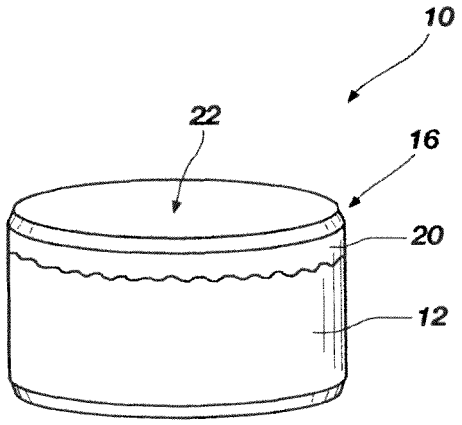
FIG. 1 (PRIOR ART)
FIG. 1 shows a perspective view of a conventional DEI.
Figure 2:
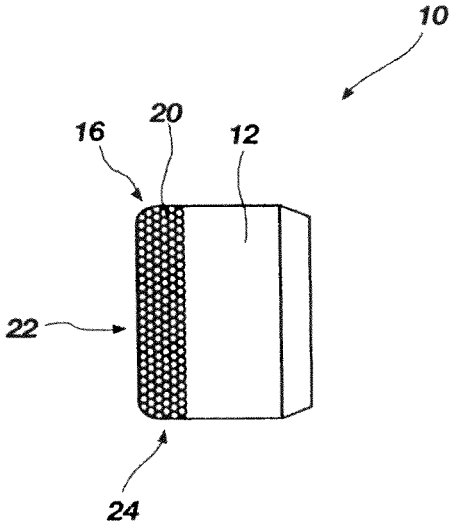
FIG. 2 (PRIOR ART)
FIG. 2 shows a schematic side cross-sectional view of the conventional DEI shown in FIG. 1.
Figure 3:
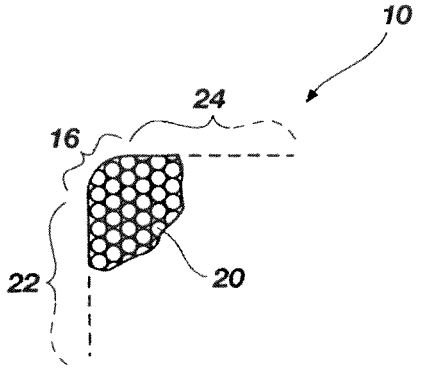
FIG. 3 (PRIOR ART)
FIG. 3 shows a partial, enlarged view of the conventional DEI shown in FIG. 2.
Figure 4:
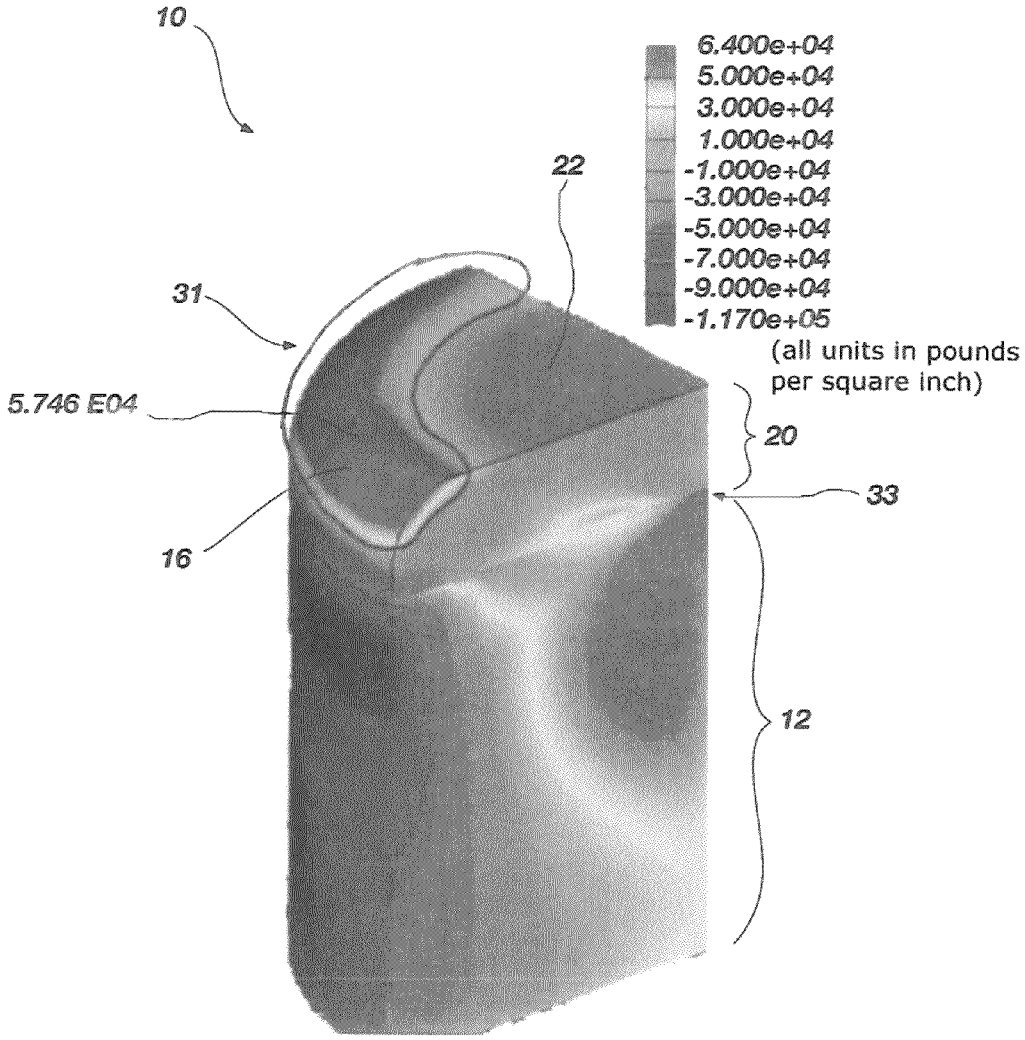
FIG. 4 (PRIOR ART)
FIG. 4 shows a partial, sectioned view of the conventional DEI shown in FIGS. 1-3, wherein the DEI is shaded according to finite element analysis data representing a stress field within the conventional DEI.
Figure 5:
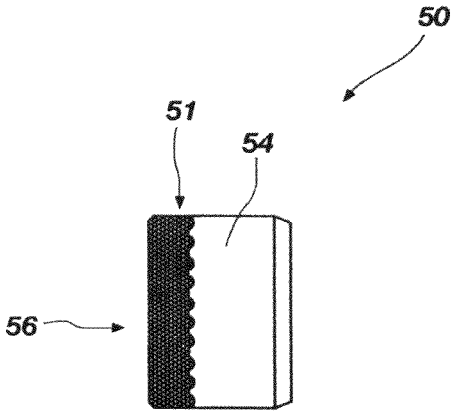
FIG. 5 (PRIOR ART)
FIG. 5 shows a schematic side cross-sectional view of another conventional DEI.
Figure 6:
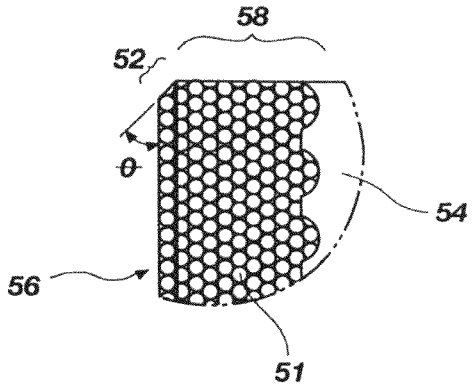
FIG. 6 (PRIOR ART)
FIG. 6 shows a partial, enlarged view of the conventional DEI shown in FIG. 5.
Figure 7:
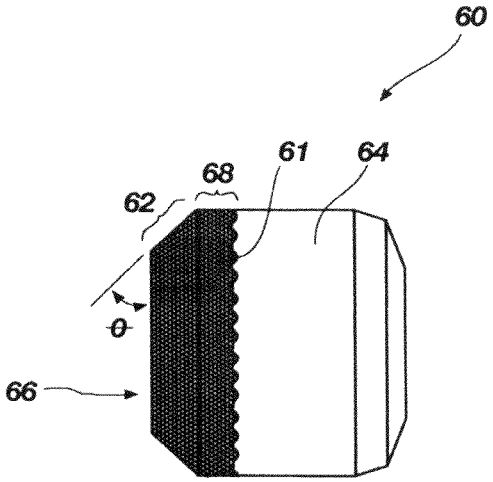
FIG. 7 (PRIOR ART)
FIG. 7 shows a schematic side cross-sectional view of yet an additional conventional DEI.
Figure 8:
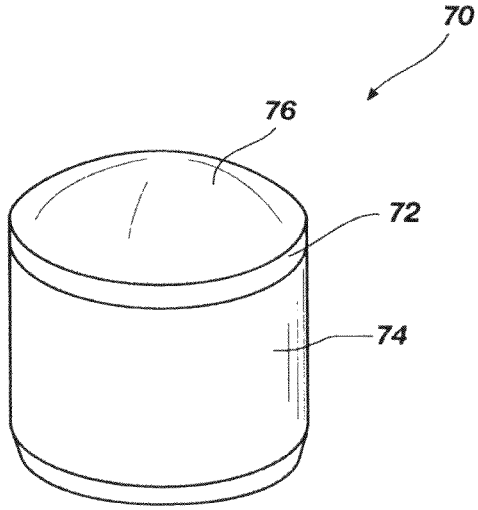
FIG. 8 (PRIOR ART)
FIG. 8 shows a perspective view of a further conventional DEI including a hemispherical surface.
Figure 21:
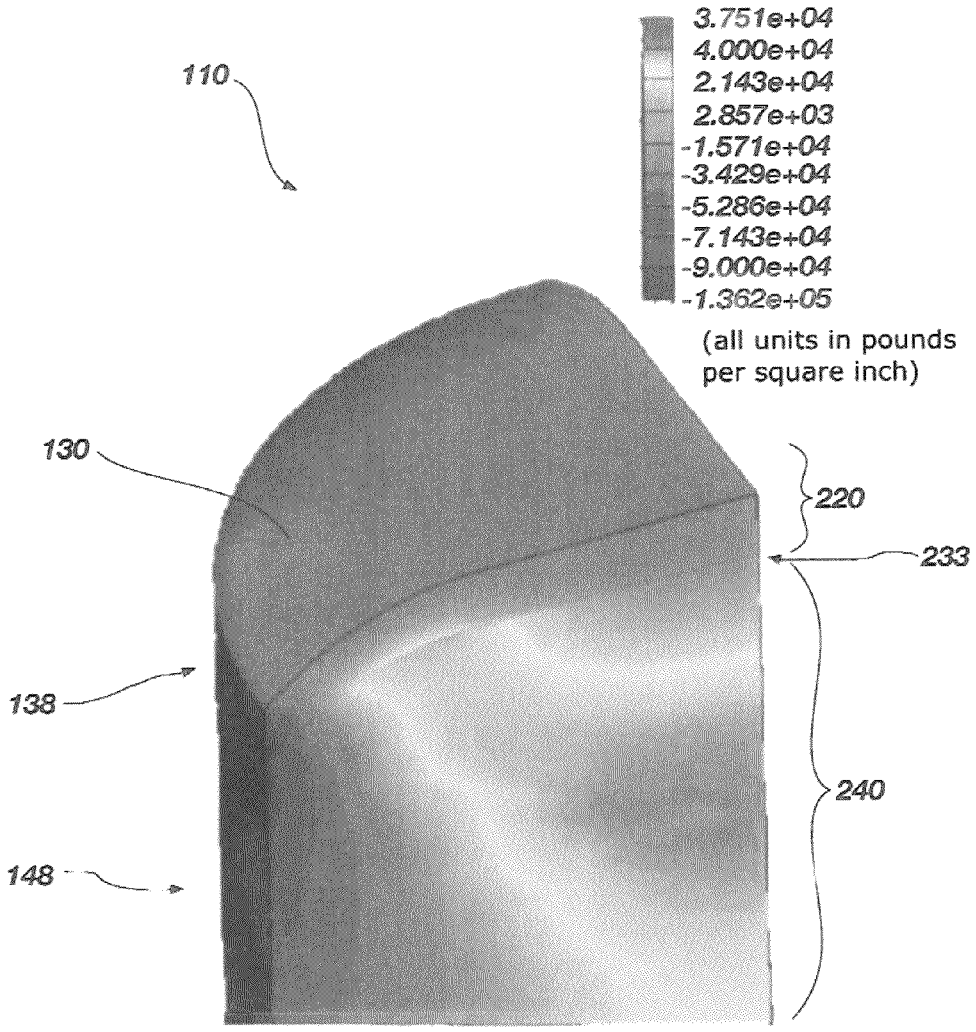
FIG. 21 shows a partial, sectioned view of one embodiment of a superabrasive insert according to the present invention, wherein the superabrasive insert is shaded according to finite element analysis data representing a stress field within the superabrasive insert.

The inventor of this application has also discovered that a superabrasive insert according to the present invention may exhibit reduced tensile residual stresses. Particularly, FIG. 21 shows a partial sectioned view of a superabrasive insert 110 as shown in FIGS. 9-13, wherein the superabrasive insert 110 is shaded according to data representing a stress field within a superabrasive insert 110 comprising a polycrystalline diamond layer 220 including an arcuate peripheral surface 130. As shown in FIG. 21, an interface 233 between polycrystalline diamond layer 220 and substrate 240 may generally follow an exterior surface shape (i.e., an arcuate peripheral surface 130 topography) of polycrystalline diamond layer 220. More particularly, FIG. 21 was generated by using finite element analysis to simulate the residual stresses developed during HPHT sintering of a diamond layer 220 and substrate 240 as well as stresses developed in response to press fitting the substrate within a hole formed in a steel material. As shown in FIG. 21, tensile stress within diamond layer 220 is significantly reduced in comparison to the tensile stresses within the diamond layer 20 predicted in the conventional DEI 10 depicted in FIG. 4. In fact, tensile stresses proximate to arcuate peripheral surface 130 of diamond layer 220 appear to have been substantially eliminated. Overall, in comparison to the conventional DEI 10 shown in FIG. 4, tensile stresses in the diamond layer 220 of superabrasive insert 110 are 42% less. In addition, in comparison to the conventional DEI 10 shown in FIG. 4, compressive stresses in the diamond layer 220 of superabrasive insert 110 are 31% higher, which may generally be beneficial. Such a configuration may inhibit fracture initiation and propagation within the diamond layer 220.

Figure 22:
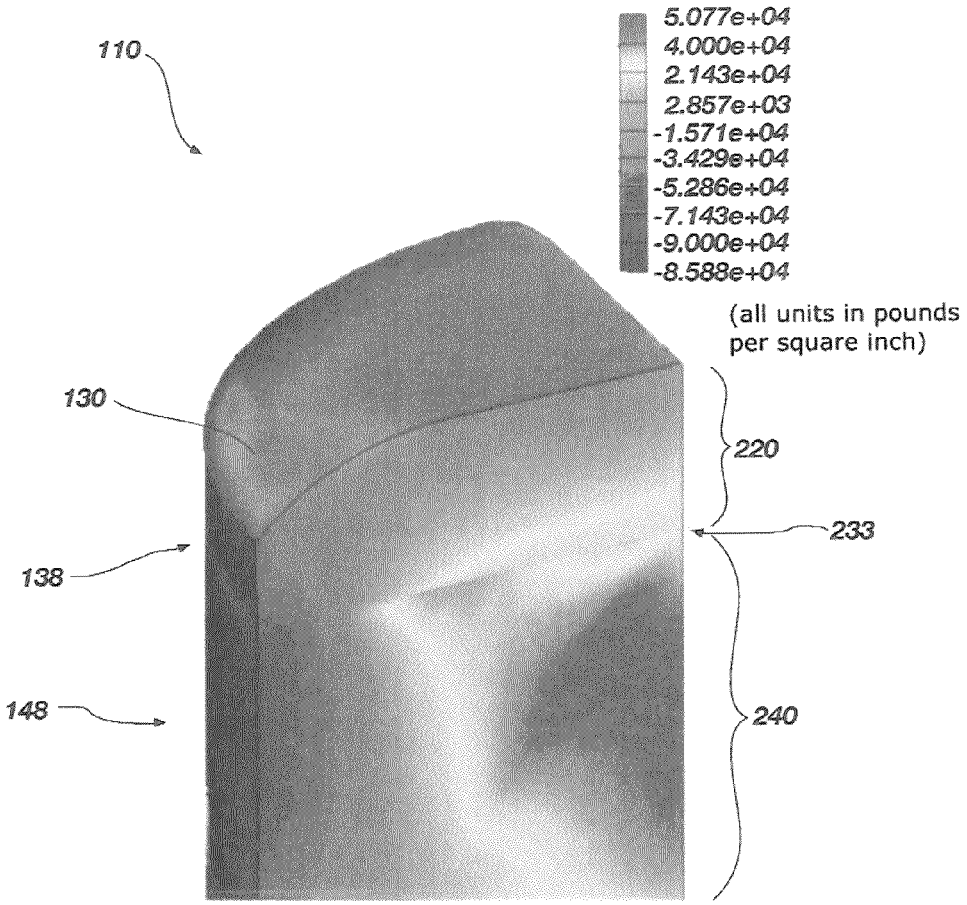
FIG. 22 shows a partial sectioned view of another embodiment of a superabrasive insert according to the present invention, wherein the superabrasive insert is shaded according to finite element analysis data representing a stress field within the superabrasive insert.

As an additional example of reduction of residual stresses resulting from an arcuate peripheral surface, FIG. 22 shows a partial sectioned view of a superabrasive insert 110, wherein the superabrasive insert 110 is shaded according to data representing a stress field within a superabrasive insert 110. Explaining further, a finite element analysis was performed for a superabrasive insert 110 comprising a polycrystalline diamond layer 220 including an arcuate peripheral surface 130. As shown in FIG. 21, an interface 233 between polycrystalline diamond layer 220 and substrate 240 may be substantially planar. More particularly, FIG. 22 was generated by using finite element analysis to simulate the residual stresses developed during HPHT sintering of a diamond layer 220 to a tungsten carbide substrate 240 as well as stresses developed in response to press fitting the substrate within a hole formed in a steel material. As shown in FIG. 22, tensile stress within diamond layer 220 is significantly reduced in comparison to the tensile stresses within the diamond layer 20 predicted in the conventional DEI 10 depicted in FIG. 4. Overall, in comparison to the conventional DEI 10 shown in FIG. 4, tensile stresses in the diamond layer 220 of superabrasive insert 110 are less, while compressive stresses in the diamond layer 220 of superabrasive insert 110 are higher. Such a configuration may inhibit fracture initiation and propagation within the diamond layer 220.

Figure 23:
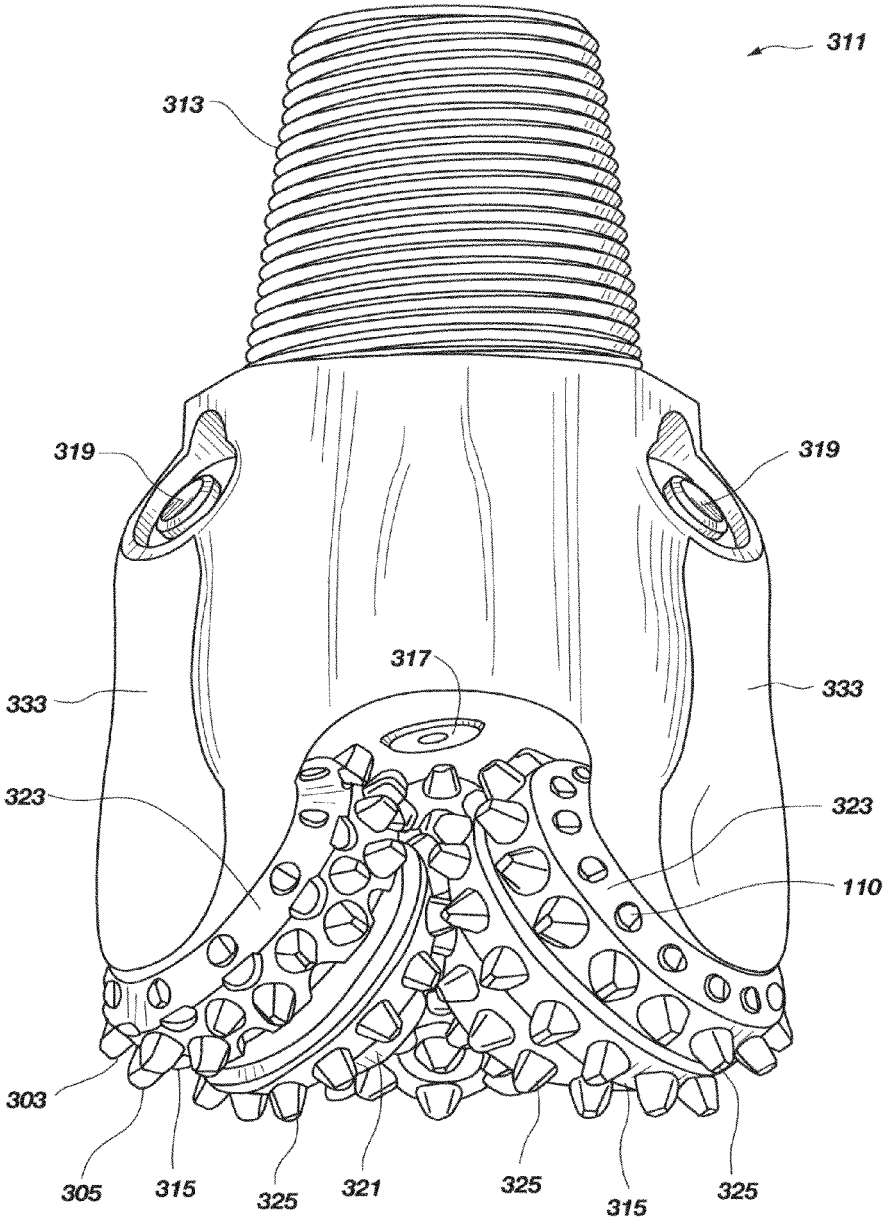
FIG. 23 shows a perspective view of one embodiment of a subterranean drill bit including at least one superabrasive insert according to the present invention.

The present invention further contemplates that at least one superabrasive insert may be installed upon any subterranean drill bit or other drilling tool for forming a borehole in a subterranean formation known in the art. For example, at least one superabrasive insert may be affixed to a roller cone drill bit and may be used for cutting or maintaining a gage of a borehole. FIG. 23 shows a perspective view of a subterranean drill bit 311 including at least one superabrasive insert 110 according to the present invention. Referring to FIG. 23, a subterranean drill bit 311 may have a threaded pin section 313 on its upper end for securing the bit to a string of drill pipe. A plurality of rotating cones 315, usually three, are rotatably mounted on bearing shafts (not shown) carried by legs 333 extending from the bit body. At least one nozzle 317 may be provided to discharge drilling fluid pumped from the drill string to the bottom of the borehole. A lubricant pressure compensator system 319 is provided for each cone 315 to reduce a pressure differential between the borehole fluid and the lubricant in the bearings of the cones 315.

Each cone 315 may be generally conical (or frustoconical) and includes a nose area 321 proximate the apex of the cone, and a gage surface 323 at the base of the cone. The gage surface 323 may be frustoconical and may be adapted to contact the sidewall of the borehole as the cone 315 rotates about the borehole bottom. Each cone 315 has a plurality of wear-resistant inserts 325 secured by interference fit into mating sockets drilled in the supporting surface of the cone 315. These wear-resistant inserts 325 may be constructed of a superabrasive material, such as cemented tungsten carbide. Inserts 325 generally are located in rows extending circumferentially about the generally conical surface of the cone 315. Some of the rows of one cone 315 may be arranged to intermesh with other rows on other cones 315. Optionally, one or two of the cones 315 may have staggered rows including a first row 303 of inserts and a second row 305 of inserts. A first or heel row 303 is a circumferential row that is closest to the edge of the gage surface 323. Examples of conventional gage trimmers are disclosed by U.S. Pat. Nos. 5,467,836 and 6,883,623, the disclosures of which are incorporated herein, in their entireties, by this reference.

According to the present invention, as shown in FIG. 23, at least one insert 110 may be installed on the gage surface 323 of at least one cone 315. Put another way, at least one superabrasive insert 110 may be used as a gage insert. Such a configuration may prevent or limit gage surface 323 from contacting a borehole or casing. In one embodiment, a plurality of inserts 110 may be affixed to each of roller cones 315. More generally, one or more insert 110 may be affixed to one or more of roller cones 315. Of course, other embodiments are contemplated by the present invention, one being a repeating pattern of one or more inserts 110 circumferentially separated by other protective structures or other gage trimmers or inserts.

Figure 24:
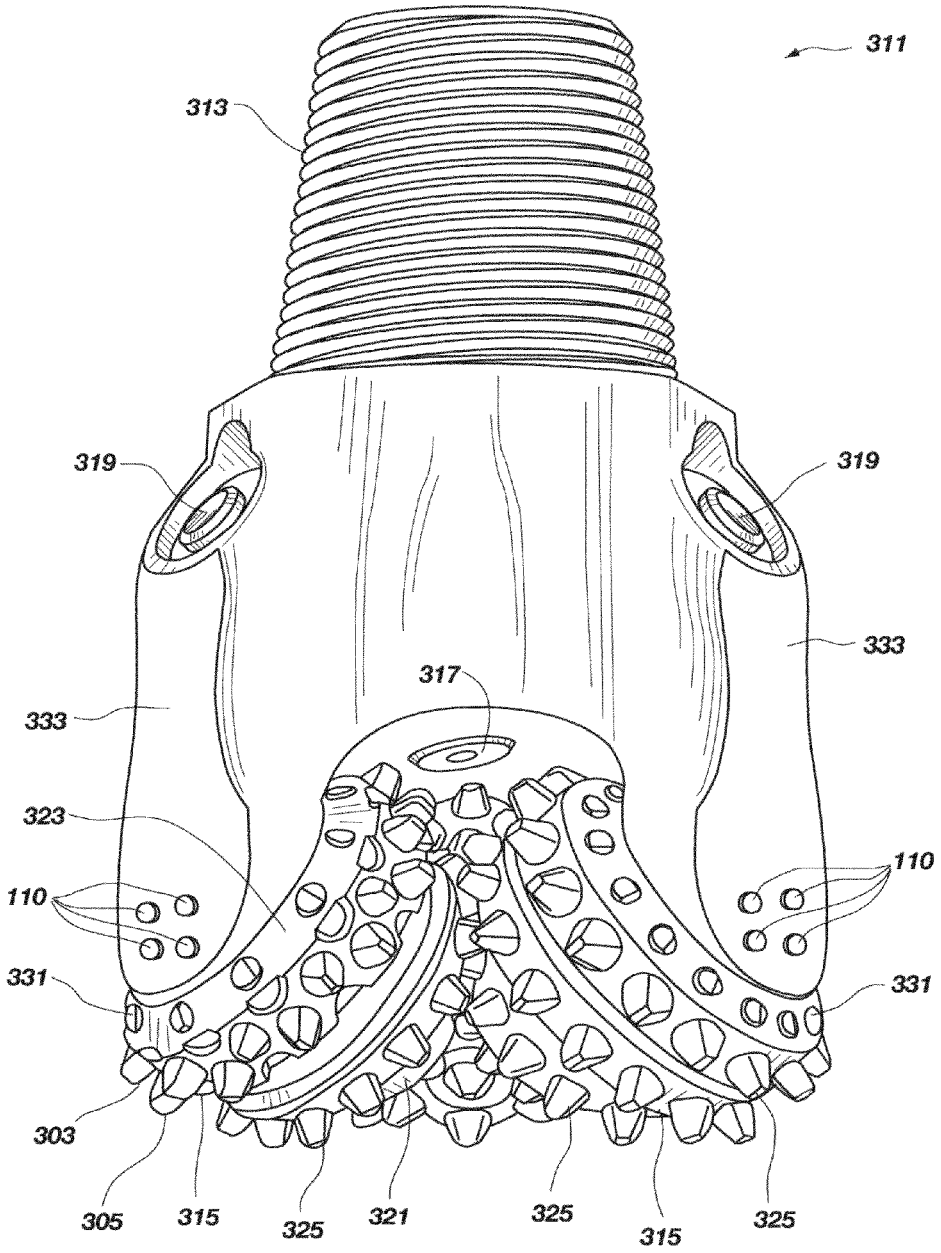
FIG. 24 shows a perspective view of another embodiment of a subterranean drill bit including at least one superabrasive insert according to the present invention.

In another embodiment, at least one superabrasive insert may be carried on an exterior surface of a leg of a roller cone drill bit. For example, FIG. 24 shows a perspective view of a subterranean drill bit 311 as described above in relation to FIG. 23, wherein a plurality of superabrasive inserts 110 are affixed to legs 333 of the subterranean drill bit 311. More generally, one or more (i.e., one or a plurality of) superabrasive insert 110 may be carried by one or more leg 333 of subterranean drill bit 311. As shown in FIG. 24, gage inserts 331 are affixed or secured to gage surface 323 of cones 315. Of course, such one or more superabrasive insert 110 may be configured as gage inserts 331, if desired. Put another way, one or more of gage inserts 331, as shown in FIG. 24, may comprise a superabrasive insert 110 according to the present invention. Of course, such "gage inserts" or "gage trimmers" and may be carried by subterranean drill bit bodies of many types.

Figure 25:
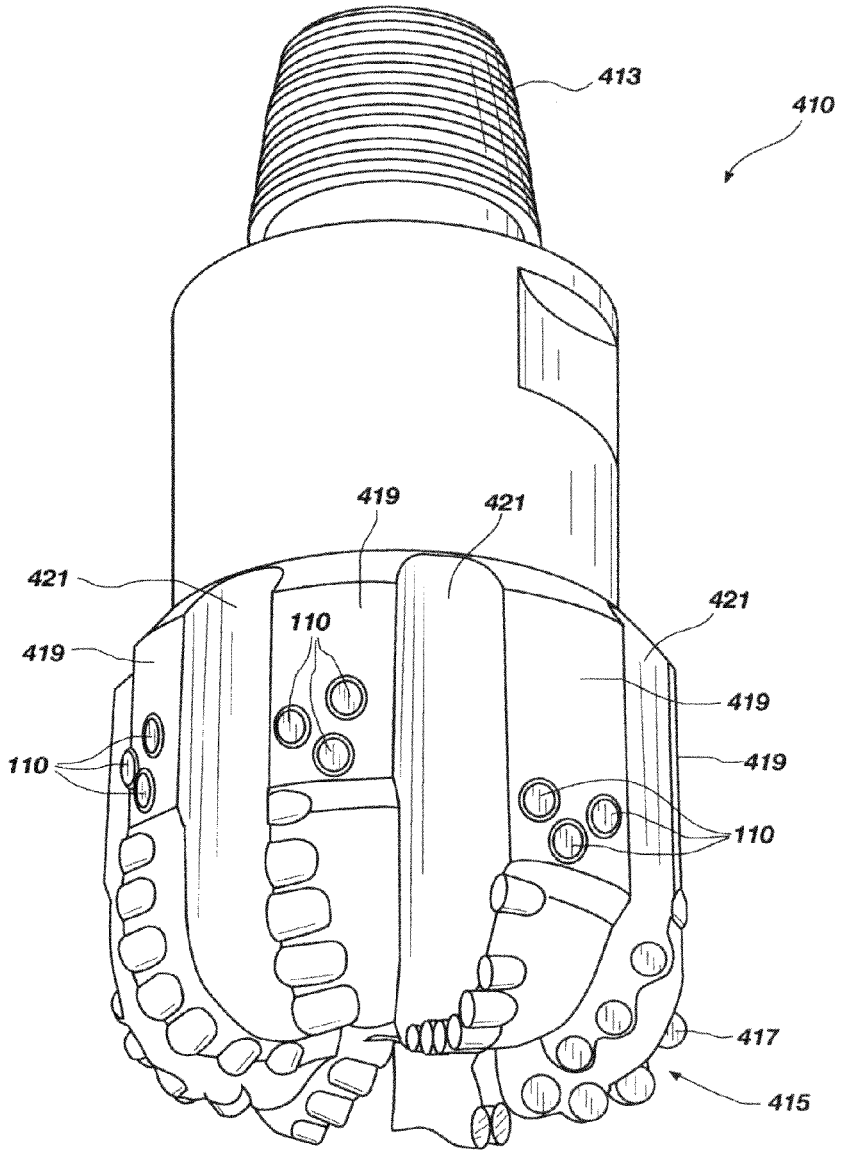
FIG. 25 shows a perspective view of a further embodiment of a subterranean drill bit including at least one superabrasive insert according to the present invention.

In a further example, at least one superabrasive insert according to the present invention may be affixed to a so-called "fixed cutter" subterranean drill bit. More particularly, FIG. 25 is a perspective view of a subterranean drill bit 410 including at least one superabrasive insert 110. Bit 410 is threaded 413 at its upper extent for connection into a drill string. A cutting face 415 at a generally opposite end of bit 410 is provided with a plurality of cutting elements 417, arranged about cutting face 415 to effect drilling into a subterranean formation as bit 410 is rotated in a borehole. In one embodiment, a plurality of radially extending blades may extend from the bit body of the subterranean drill bit 410, as known in the art. A gage surface 419 (also know as gage pads) extends upwardly from cutting face 415 (e.g., from each of the bit blades) and may be proximate to and may contact the sidewall of the borehole during drilling operation of bit 410. A plurality of channels or grooves 421 (also known as "junk slots") extend generally from cutting face 415 through gage surface 419 to provide a clearance area for formation and removal of chips formed by cutters 417. As shown in FIG. 25, at least one superabrasive insert 110 may be affixed to a gage surface 419 of drill bit 410. More specifically, a plurality of superabrasive inserts 110 may be affixed to (e.g., by press fitting, brazing, etc.) drill bit 410 and may be positioned generally upon gage surface (or pad) 419. The substantially planar surface of a superabrasive insert 110 may be substantially tangent to the gage surface 419 (e.g., which may be substantially cylindrical) and may extend a nominal distance beyond gage surface 419 a distance of between about 0.015 and about 0.030 inch, for most bits. Thus, such superabrasive inserts 110 may provide the ability to actively shear formation material at the sidewall of the borehole to provide improved gage-holding ability in subterranean drill bits. Drill bit 410, in one embodiment, may be a PDC ("polycrystalline diamond cutter").

In addition, one of ordinary skill in the art will appreciate that superabrasive inserts 110 may be equally useful in other fixed cutter or drag bits that include a gage surface for engagement with the sidewall of the borehole. More generally, the present invention contemplates that the drill bits discussed above may represent any number of earth-boring tools or drilling tools, including, for example, core bits, roller-cone bits, fixed-cutter bits, eccentric bits, bicenter bits, reamers, reamer wings, or any other downhole tool for forming or enlarging a borehole that includes at least one superabrasive insert, without limitation.

Figure 26:
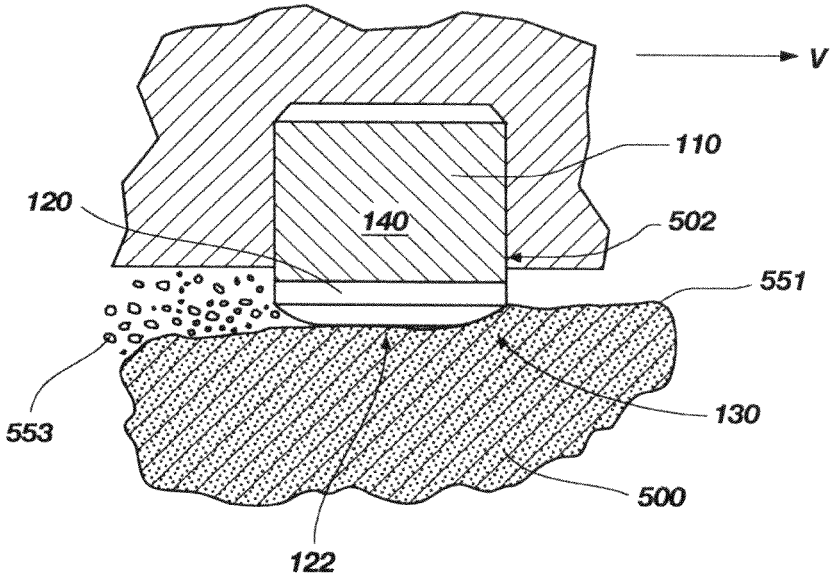
FIG. 26 shows a schematic side cross-sectional view of a superabrasive insert during operation.

Thus, in one embodiment, a superabrasive insert according to the present invention may engage or abut against a subterranean formation in a direction that is generally parallel to a central substantially planar surface of the superabrasive insert. For example, FIG. 26 shows, in a simplified cross-sectional view, one embodiment of superabrasive insert 110 during operation. More particularly, FIG. 26 shows superabrasive insert 110 positioned within a recess 502 and moving in generally in direction v. One of ordinary skill in the art will understand that superabrasive insert 110 may follow an arcuate path (e.g., helical, upon a rotating cone, etc.) as known in the art, in addition or as opposed to direction v as shown in FIG. 26.

As discussed above, in one embodiment, recess 502 may be formed in a subterranean drill bit. Superabrasive insert 110 may be sized to exhibit an interference fit (i.e., press fit) within recess 502, may be brazed within recess 502, or may be coupled to recess 502 as otherwise known in the art. As discussed in greater detail below, an insert contemplated by the present invention may be affixed to any subterranean drilling tool or drill bit as known in the art. As discussed above, an insert according to the present invention may be affixed to a roller cone of a roller-cone type drill bit (e.g., a TRI-CONE® type drill bit), a leg of a roller cone type subterranean drill bit, or a gage region of a fixed cutter type subterranean drill bit.

The geometry and dynamics of the cutting action of a rolling cone type or fixed cutter type subterranean drill bit are extremely complex, but the operation of the superabrasive insert 110 of the present invention is believed to be similar to that of a metal-cutting tool. Particularly, as the superabrasive insert 110 rotates along a surface of the borehole, the arcuate peripheral surface 130, substantially planar surface 122, or both of each superabrasive insert 110 may come in proximity or contact with a borehole surface 551 of the subterranean formation 500. Because the substantially planar surface 122 is proximal to the borehole surface 551 of the subterranean formation 500, at least a portion of the arcuate peripheral surface 130 may contact the borehole surface 551 of the subterranean formation 500. The arcuate peripheral surface 130 of the superabrasive insert 110 may shearingly cut or otherwise remove the material of the borehole surface 551 of the subterranean formation 500. Thus, the superabrasive insert 110 may remove material from the borehole surface 551 of the subterranean formation 500, thus shearing off fragments or chips 553 of the subterranean formation. The substantially planar surface 122 of the superabrasive insert 110 may remain at least partially in contact with the borehole surface 551 of the subterranean formation, and thus may be subject to abrasive wear during operation. As noted above, resistance to fracture of the arcuate peripheral surface 130 may be enhanced because tensile stresses within the superabrasive layer 120 may be reduced or minimized.

Again, because the cutting dynamics of subterranean drill bits are complicated and vary depending on downhole conditions, the exact cutting action of the a superabrasive insert 110 affixed to a gage region of a subterranean drill bit may not be fully understood. It is believed that providing an arcuate peripheral surface upon an superabrasive insert will allow a suitable cutting edge for contacting a borehole surface notwithstanding geometric intricacies of the subterranean drill bit design, dynamics of such a drill bit, or the characteristics of a subterranean formation being drilled. Providing an arcuate peripheral surface is thought to provide a more robust cutting edge at a point on the superabrasive insert 110 that is believed to contact the surface of a borehole 551 most frequently. As discussed above, such an arcuate peripheral surface may be more damage resistant when removing a portion of a borehole sidewall 551 than other types of edges.

Although superabrasive inserts and drilling tools described above have been discussed in the context of subterranean drilling equipment and applications, it should be understood that such superabrasive inserts and systems are not limited to such use and could be used for varied applications as known in the art, without limitation. Thus, such superabrasive inserts are not limited to use with subterranean drilling systems and may be used in the context of any mechanical system including at least one superabrasive insert. In addition, while certain embodiments and details have been included herein for purposes of illustrating aspects of the instant disclosure, it will be apparent to those skilled in the art that various changes in the systems, apparatuses, and methods disclosed herein may be made without departing from the scope of the instant disclosure, which is defined, at least in part, in the appended claims. The words "including" and "having," as used herein including the claims, shall have the same meaning as the word "comprising."

What is claimed is:

1. A superabrasive insert comprising:

a superabrasive layer bonded to a substrate at an interface, the superabrasive layer including an upper surface and a side surface;

wherein a cross section of one half of the upper surface comprises:

a centrally substantially planar surface, at least one arc extending radially outwardly from the centrally substantially planar surface, and at least one chamfer extending radially outwardly from the at least one arc, wherein the at least one chamfer is positioned between the at least one arc and the side surface, wherein the substantially planar surface is tangent to the at least one arc at an intersection between the at least one arc and the substantially planar surface;

wherein the radially innermost point of the at least one arc and the radially outermost point of at least one chamfer exhibit a lateral extent and an extension depth, wherein a ratio of the lateral extent to the extension depth exceeds 1.0.

2. The superabrasive insert of claim 1, wherein the superabrasive layer comprises a polycrystalline diamond layer and the substrate comprises tungsten carbide.

3. The superabrasive insert of claim 2, wherein the superabrasive layer includes a region substantially devoid of a catalyst used for forming the polycrystalline diamond layer.

4. The superabrasive insert of claim 1, wherein the at least one chamfer extends to the side surface.

5. The superabrasive insert of claim 1, wherein the at least one arc includes at least one of an elliptical arc and a circular arc.

6. The superabrasive insert of claim 1, wherein the interface is nonplanar.

7. The superabrasive insert of claim 6, wherein the interface comprises a plurality of grooves.

8. The superabrasive insert of claim 1, wherein the ratio of the lateral extent to the extension depth is at least about 1.5.

9. A rotary drill bit for drilling a subterranean formation, comprising:

a bit body comprising a leading end structured for facilitating drilling of a subterranean formation;

at least one superabrasive insert comprising:

a superabrasive layer bonded to a substrate at an interface, the superabrasive layer including an upper surface and a side surface;

wherein a cross section of one half of the upper surface comprises:

a centrally substantially planar surface, at least one arc extending radially outwardly from the centrally substantially planar surface, and at least one chamfer extending radially outwardly from the at least one arc, wherein the at least one chamfer is positioned between the at least one arc and the side surface, wherein the substantially planar surface is tangent to the at least one arc at an intersection between the at least one arc and the substantially planar surface;

wherein the radially innermost point of the at least one arc and the radially outermost point of at least one chamfer exhibit a lateral extent and an extension depth, wherein a ratio of the lateral extent to the extension depth exceeds 1.0.

10. The rotary drill bit of claim 9, wherein the ratio of the lateral extent to the extension depth is at least about 1.5.

11. The rotary drill bit of claim 9, wherein the superabrasive layer comprises a polycrystalline diamond layer and the substrate comprises tungsten carbide.

12. The rotary drill bit of claim 11, wherein the superabrasive layer includes a region substantially devoid of a catalyst used for forming the polycrystalline diamond layer.

13. The rotary drill bit of claim 9, wherein the at least one arc includes at least one of an elliptical arc and a circular arc.

14. The rotary drill bit of claim 9, wherein the at least one arc is adjacent the central substantially planar surface and the at least one chamfer is positioned between the at least one arc and the peripheral side surface.

15. The rotary drill bit of claim 9, wherein the interface is nonplanar.

16. The rotary drill bit of claim 15, wherein the interface comprises a plurality of grooves.

17. The rotary drill bit of claim 9, further comprising at least one roller cone rotatable coupled with the bit body and wherein the at least one superabrasive insert is coupled with the at least one roller cone.

18. The rotary drill be of claim 9, further comprising a gage surface, wherein the at least one superabrasive insert is disposed within the gage surface.

* * * * *